US007909212B2

(12) United States Patent
Parve

(10) Patent No.: US 7,909,212 B2
(45) Date of Patent: Mar. 22, 2011

(54) CLOSURE FOR A CONTAINER

(75) Inventor: Terrence M. Parve, Menomonee Falls, WI (US)

(73) Assignee: Gateway Plastics, Inc., Mequon, WI (US)

( * ) Notice: Subject to any disclaimer, the term of this patent is extended or adjusted under 35 U.S.C. 154(b) by 356 days.

(21) Appl. No.: 11/799,737

(22) Filed: May 2, 2007

(65) Prior Publication Data

US 2008/0087690 A1 Apr. 17, 2008

Related U.S. Application Data

(60) Provisional application No. 60/797,464, filed on May 3, 2006.

(51) Int. Cl.
*B65D 47/00* (2006.01)

(52) U.S. Cl. ..... 222/480; 222/485; 222/545; 222/548; 222/565

(58) Field of Classification Search ..... 222/485, 222/480, 545, 552, 565, 548, 555, 506, 507, 222/557

See application file for complete search history.

(56) References Cited

U.S. PATENT DOCUMENTS

| | | | | | |
|---|---|---|---|---|---|
| 2,108,063 | A * | 2/1938 | Hothersall | 222/507 |
| 3,115,994 | A * | 12/1963 | Grady | 222/480 |
| 4,380,307 | A * | 4/1983 | Stillinger | 222/142.9 |
| 4,823,995 | A * | 4/1989 | Lewis | 222/545 |
| 5,193,704 | A * | 3/1993 | Kick | 220/253 |
| 5,219,100 | A * | 6/1993 | Beck et al. | 222/480 |
| 5,305,931 | A * | 4/1994 | Martin et al. | 222/480 |
| 5,383,582 | A * | 1/1995 | Baxter et al. | 222/548 |
| RE37,634 | E * | 4/2002 | Hickman et al. | 222/480 |
| 6,364,169 | B1 * | 4/2002 | Knickerbocker | 222/189.02 |
| 2002/0079339 | A1 * | 6/2002 | Sheffler et al. | 222/480 |
| 2006/0278665 | A1 * | 12/2006 | Bennett | 222/480 |

* cited by examiner

*Primary Examiner* — Kevin P Shaver
*Assistant Examiner* — Donnell Long
(74) *Attorney, Agent, or Firm* — Foley & Lardner LLP

(57) ABSTRACT

A closure for a receptacle of a type having an open top and a closed bottom is provided. The closure comprises a base configured to be coupled to the top of the receptacle and a cover coupled to the base and rotatable relative thereto. The cover includes a flap having an outer edge with a downwardly extending skirt and is configured for selective movement between an open position and a closed position. The closure further comprises and an insert supported between the base and the cover. The insert defines at least one dispensing aperture and is rotatable relative to the base. Rotation of the cover rotates the insert relative to the base.

20 Claims, 9 Drawing Sheets

CLOSURE FOR A CONTAINER

CROSS-REFERENCE TO RELATED PATENT APPLICATIONS

The present application claims the benefit under 35 U.S.C. §119(e) of U.S. Provisional Application No. 60/797,464, having a filing date of May 3, 2006, titled "Closure for Container," the disclosure of which is hereby incorporated by reference in its entirety.

BACKGROUND

It is well known to provide a closure having one or more apertures for dispensing matter that is provided within a container (e.g. particulate food stuffs or the like, such as cheese, spices, etc.). Such known closures typically have a base coupled to an opening of a receptacle and a top having one or more dispensing apertures for dispensing the matter. Such known closures may have a removable cover or elements such as flaps that are moveable between an open position in which the matter may be readily dispensed from the container (through the dispensing apertures) and a closed position in which the dispensing apertures are covered (so that the matter cannot readily be dispensed).

SUMMARY

One exemplary embodiment relates to a closure for a receptacle of a type having an open top and a closed bottom. The closure comprises a base configured to be coupled to the top of the receptacle and a cover coupled to the base and rotatable relative thereto. The cover includes a flap having an outer edge with a downwardly extending skirt and is configured for selective movement between an open position and a closed position. The closure further comprises and an insert supported between the base and the cover. The insert defines at least one dispensing aperture and is rotatable relative to the base. Rotation of the cover rotates the insert relative to the base.

Another exemplary embodiment relates to a container. The container comprises a receptacle having a open top and a closed bottom and a closure coupled to the receptacle. The closure comprises a base configured to be coupled to the top of the receptacle and a cover coupled to the base and rotatable relative thereto. The cover includes a flap having an outer edge with a downwardly extending skirt and is configured for selective movement between an open position and a closed position. The closure further comprises and an insert supported between the base and the cover. The insert defines at least one dispensing aperture and is rotatable relative to the base. Rotation of the cover rotates the insert relative to the base.

Another exemplary embodiment relates to a closure for a receptacle of a type having an open top and a closed bottom. The closure comprises a base configured to be coupled to the top of the receptacle, an insert supported by the base and a cover coupled to the base and rotatable relative thereto. The base comprises a side wall, an end wall supported at the side wall and having an upper surface defining a first dispensing aperture and a first projection extending upwards in a vertical direction past the upper surface. The insert defines a second dispensing aperture configured to be selectively aligned with the first dispensing aperture and comprises at least one tab extending radially from an outer periphery of the insert. The cover comprises a flap having an outer edge with a downwardly extending skirt that is configured for selective movement between an open position and a closed position and a second projection cooperating with the first projection of the base and the tab of the insert to coordinate the rotational movement of the insert relative to the base.

DETAILED DESCRIPTION

Figure 1:
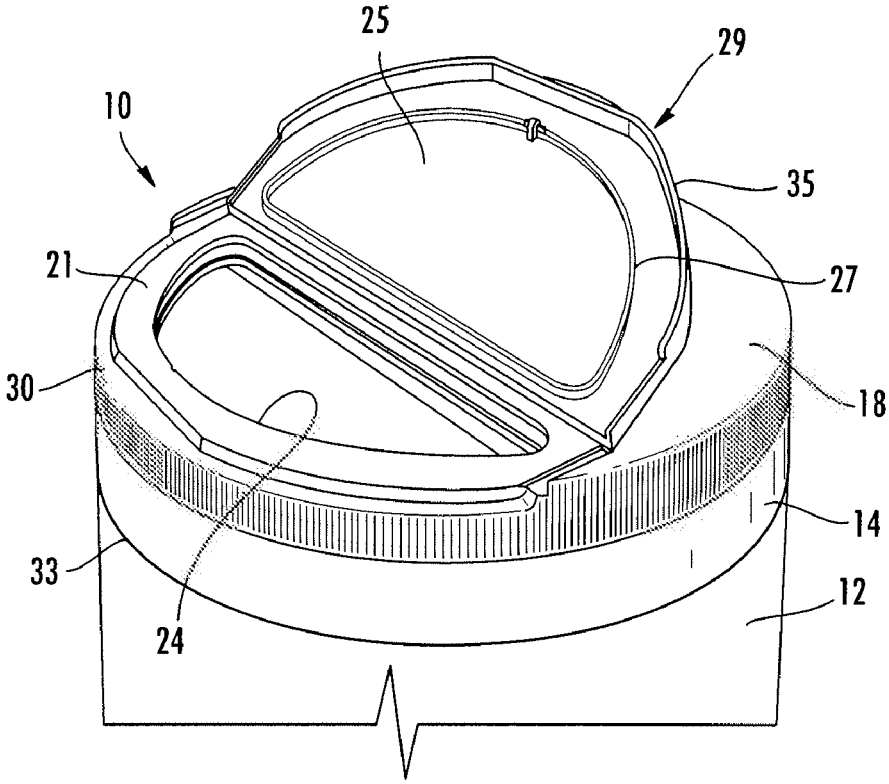
FIG. 1 is perspective view of a closure according to one exemplary showing a flap in an open position and a first dispensing aperture set.
Figure 2:
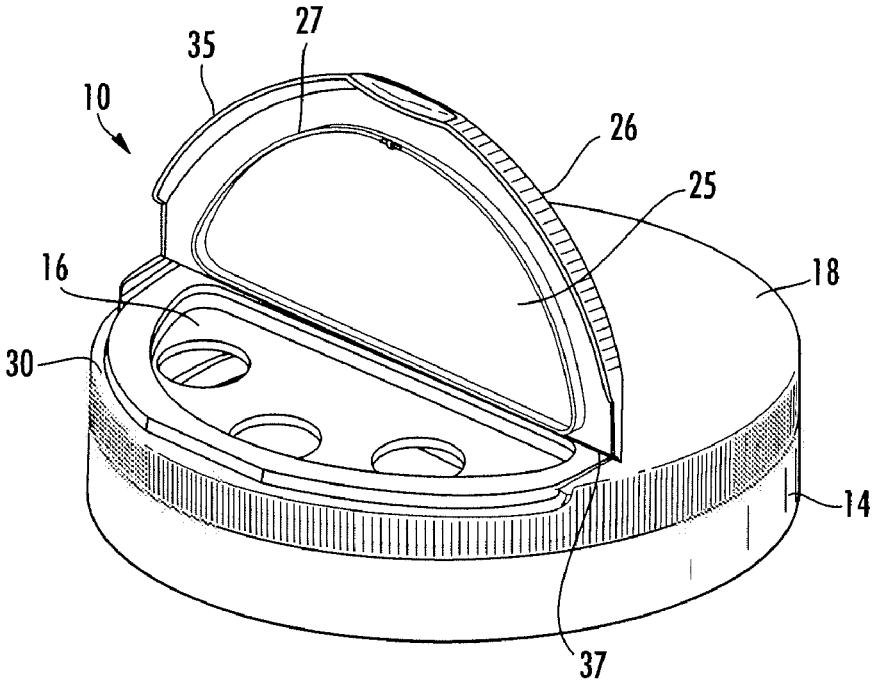
FIG. 2 is a perspective view of the closure of FIG. 1 showing the flap in the open position and a second set of dispensing apertures.
Figure 3:
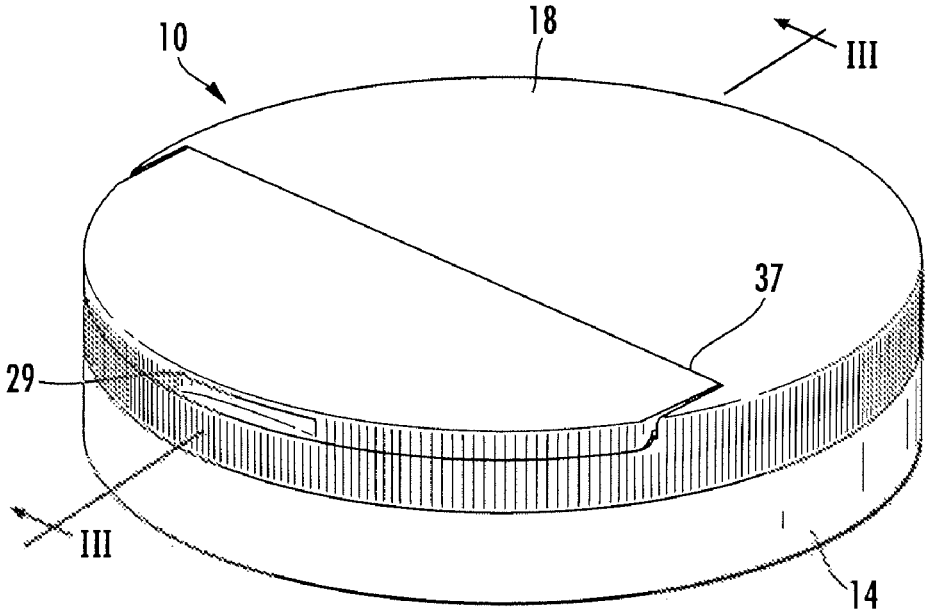
FIG. 3 is a perspective view of the closure of FIG. 1 showing the flap in a closed position.
Figure 4:
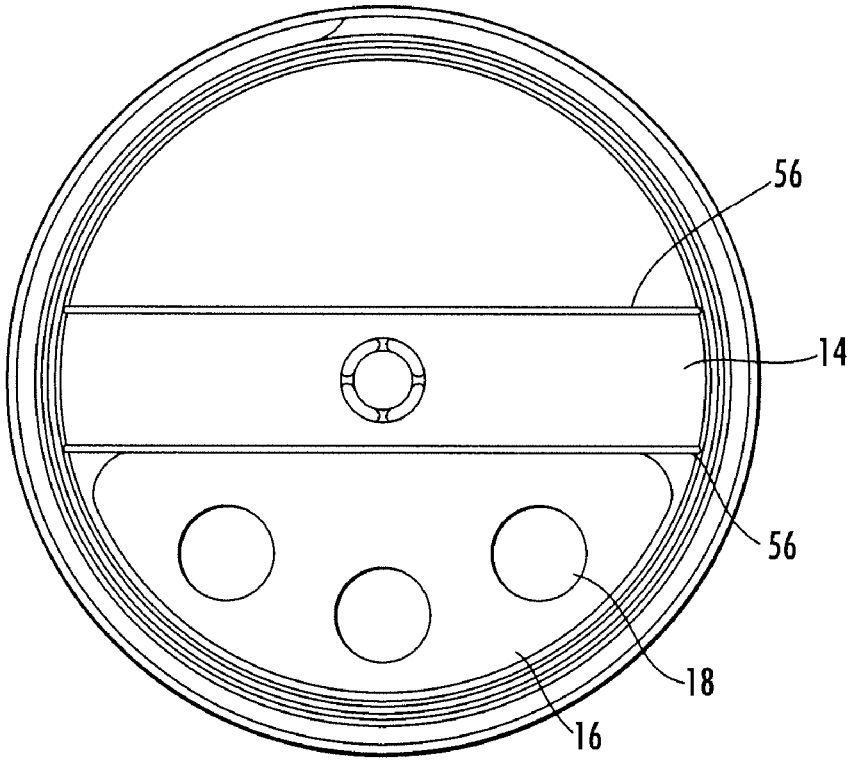
FIG. 4 is a bottom view of the closure of FIG. 1.
Figure 5:
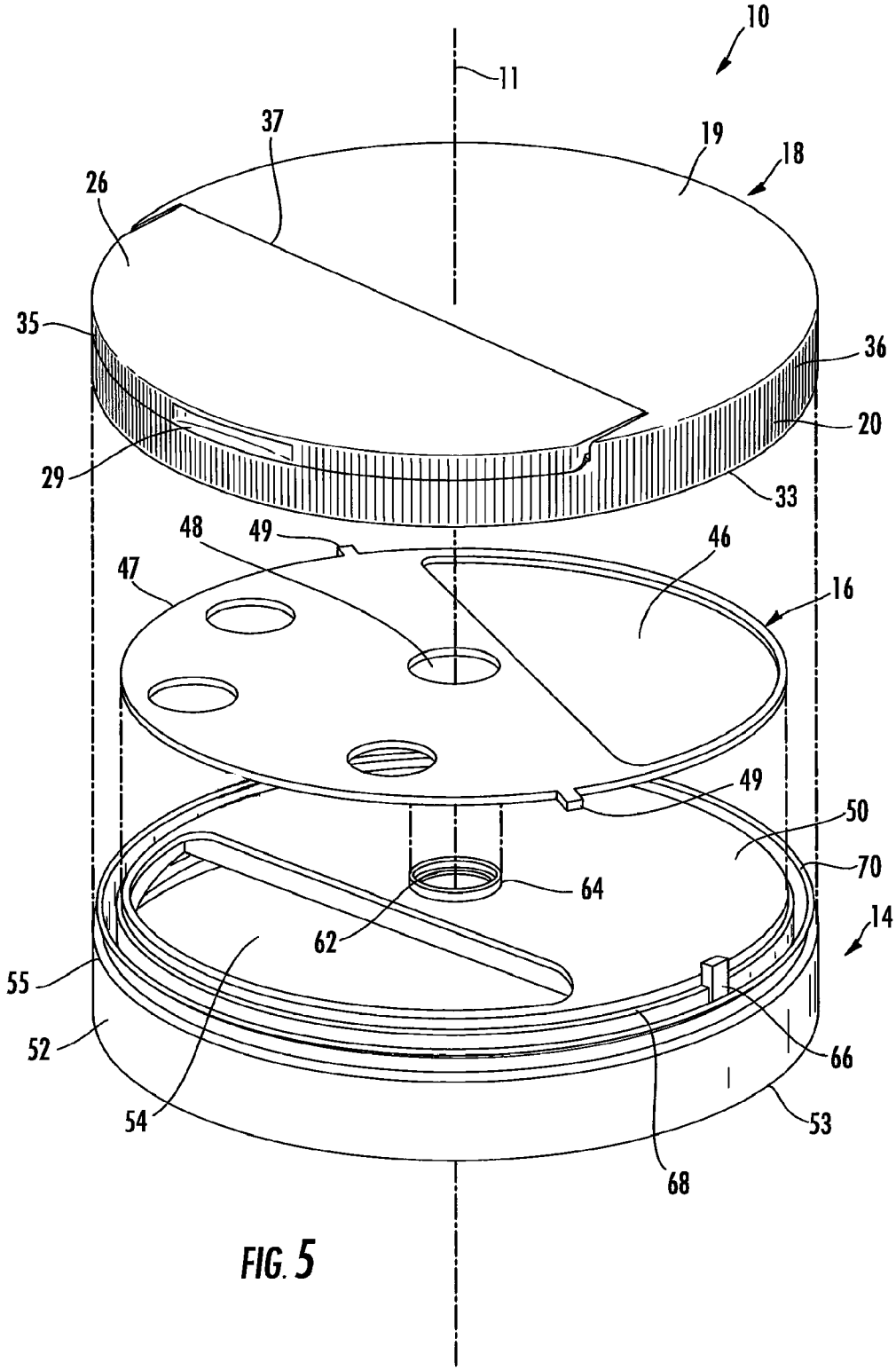
FIG. 5 is an exploded perspective view of the closure of FIG. 1.

Referring generally to FIGS. 1 through 6, a closure for a container is shown according to an exemplary embodiment. Closure 10 generally comprises a first member (e.g., body, bottom, etc.), shown as a base 14, a second member (e.g., plate, disk, panel, cut-out, intermediate member, sifter, etc.), shown as an insert 16, and a third member (e.g., cap, top, lid, etc.), shown as a cover 18. Closure 10 is configured to be coupled to a receptacle 12 with base 14, insert 16 and cover 18 each sharing a common longitudinal axis 11 (shown in FIGS. 5 and 6).

For the purpose of this disclosure, the term "coupled" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

Figure 7A:
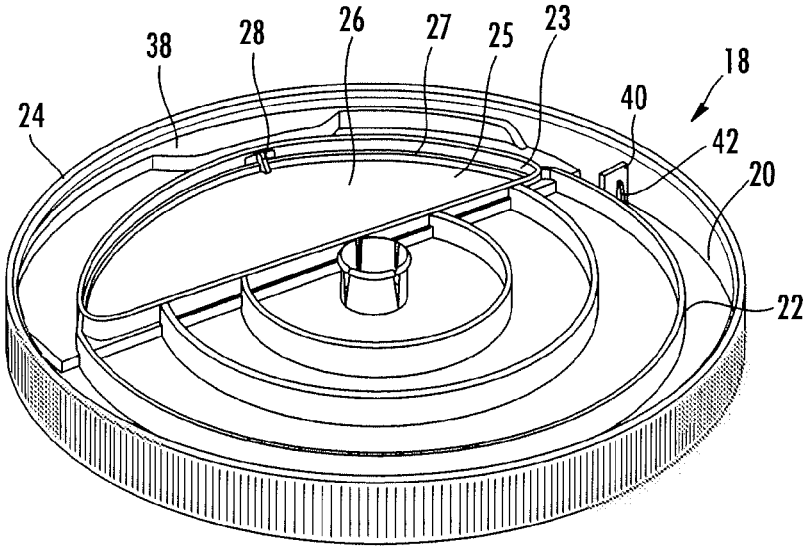
FIG. 7A is a bottom perspective view of a cover of the closure of FIG. 1.
Figure 7B:
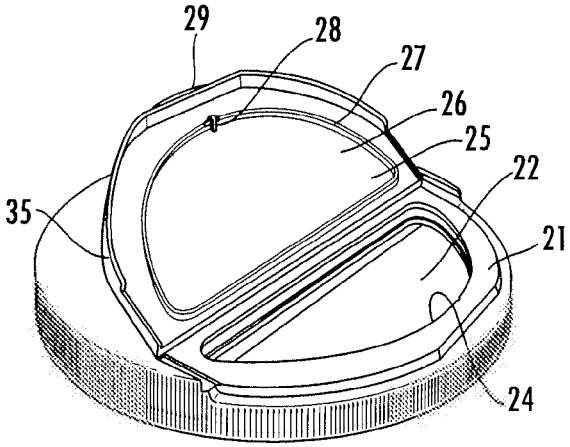
FIG. 7B is a top perspective view of the cover of FIG. 7A showing the flap in an open position.
Figure 7C:
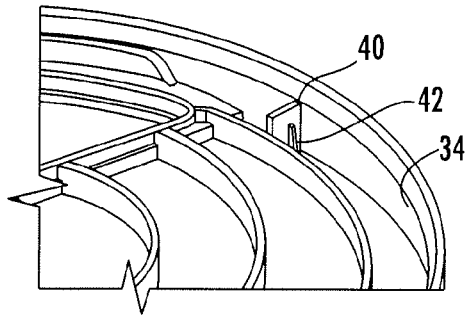
FIG. 7C is an enlarged bottom perspective view of a portion of the cover of FIG. 7A.

Referring now to FIGS. 7A and 7B, cover 18 is shown according to an exemplary embodiment. Cover 18 generally comprises a cylindrical side wall 20, an end wall 19 and a flap 26. According to the embodiment illustrated, cover 18 further comprises a rib 23, ribs 32, a reinforcing structure 38, a stop 40 and a coupling structure 43. According to one exemplary embodiment, cover 18 is integrally-formed as a single unitary body.

Side wall 20 is a hollow, generally cylindrical member having an open end 33 that is configured to receive insert 16 and a portion of base 14, and an opposite end 35 that is coupled to, and covered by, end wall 19. An outer surface of side wall 20 includes a gripping surface 36, shown as a series of corrugations around side wall 20, which is provided to allow cover 18 to be more easily grasped and rotated relative to container 12 and base 14. A coupling structure, shown as a ridge or projection 34, extends radially inward from side wall 20 proximate open end 33. Ridge 34 is configured to engage a cooperating portion of base 14 to rotatably couple cover 18 to base 14. According to one exemplary embodiment, ridge 34 is one continuous body. According to various alternative and exemplary embodiments, ridge may be several separate bodies distributed around the inner circumference of side wall 20.

End wall 19 is a generally flat and circular panel that is coupled to end 35 of sidewall 20. According to one exemplary embodiment, end wall 19 includes a recess 21, a recess 30, and an opening 22. Recess 21 is a substantially semi-circular region that occupies a little less than half of end wall 19 and that is configured to receive flap 26 in a way that allows the top surface of flap 26 to be substantially even with the top surface of the non-recessed portions of end wall 19 when flap 26 is in the closed position. Recess 30 is provided along the edge of recess 21 that corresponds to the edge of end wall 19. Recess 30 is configured to receive a skirt (described below) provided on flap 26. Opening 22 is formed within recess 21 and has a semi-circular shape that generally corresponds to the shape of recess 21. Opening 22 includes an edge 24 that forms the shape of opening 22 and that is engaged by a portion of flap 26 (e.g., tab 28, described below) when the flap 26 is in the closed position.

Flap 26 is coupled to end wall 19 (e.g., through a living hinge) and is moveable between an open position and a closed position. According to one exemplary embodiment, flap 26 comprises a body 25, a skirt 35, a projection 27, a tab 28 and an indentation 29. Body 25 is a substantially flat panel that has a substantially semi-circular shape that corresponds to the shape of recess 21. Body 25 is coupled to end wall 19 through a hinge, shown as a living hinge 37, that allows flap 26 to move between the open and closed positions. Skirt 35 is a projection that extends downwardly from the outer edge of body 25 that corresponds to the outer edge of end wall 19. According to one exemplary embodiment, at least a portion of skirt 35 extends downwardly and outwardly from flap 26 at an angle of between 9 and 25 degrees, and more preferably between 15 and 20 degrees, relative to axis 11, as described in U.S. Pat. Nos. 5,971,231, 6,250,517, 6,308,870, and 6,460,718, which are each incorporated by reference herein.

When flap 26 is moved into the closed position, skirt 35 is received within recess 30 of end wall 19. When skirt 35 is received within recess 30, skirt 35 cooperates with side wall 20 to form the appearance of a generally continuous, uniform side wall. To assist with the appearance of a continuous side wall, the outer surface of skirt 35 is corrugated to correspond with the corrugations of side wall 20 below skirt 35. Projection 27 (e.g., skirt, clean-out ring, etc.) is a generally semi-circular shaped projection that extends downwardly from the bottom surface of body 25 and that is configured to fit just inside opening 22 when flap 26 is in the closed position.

According to one exemplary embodiment, the distance projection 27 extends away from the bottom surface of body 25 is approximately equal to the thickness of the material forming the edge of opening 22 so that projection 27 may act as a partial seal that helps to prevent matter from escaping through opening 22 when flap 26 is in the closed position. According to one exemplary embodiment, at least a portion of projection 27 extends downwardly and outwardly from flap 26 at an angle of between 9 and 25 degrees, and more preferably between 15 and 20 degrees, relative to axis 11, as described in U.S. Pat. Nos. 5,971,231, 6,250,517, 6,308,870, and 6,460,718.

Tab 28 is a projection that extends downward from the bottom surface of flap 26 generally along the curved portion of projection 27 and engages an edge 24 of opening 22 when flap 26 is in the closed position. The engagement of edge 24 by tab 28 serves to releasably retain flap 26 in the closed position. According to one exemplary embodiment, tab 28 is similar to the tab described in U.S. Pat. Nos. 6,691,901 and 7,007,830, which are each incorporated by reference herein. According to one exemplary embodiment, tab 28 extends downwardly and outwardly from flap 26 at an angle of between 9 and 25 degrees, and more preferably between 15 and 20 degrees, relative to axis 11.

Indentation 29 (e.g., recess, thumb detail, thumb recess, etc.), is provided at the central outer portion of skirt 35 and is configured to receive a finger or finger nail of the user of the closure to facilitate opening flap 26. According to an alternative embodiment, the flap may be formed separately from the remaining portions of cover 18 and then coupled to one or more of such remaining portions (e.g., with a snap fit, etc.).

Ribs 23 and 32 extend perpendicularly downward from the bottom surface of end wall 19 and are intended to provide additional support, rigidity, and/or strength to cover 18, and to maintain the position of insert 16 on base 14. Rib 23 extends from the around opening 22. The three ribs 32 are concentric, radially spaced ribs that at least partially encircle coupling structure 43 located in the center of end wall 19. Each of ribs 32 intersect, and are coupled to, rib 23. Each of ribs 23 and 32 terminate in a common plane (e.g., the distal ends of each rib 32 and rib 23 are the same distance from open end 33 of side wall 20) and are generally intended to serve, at least in part, as stops to prevent insert 16 from moving away from base 14. According to one exemplary embodiment, each of ribs 23 and 32 have a generally rectangular cross-section. According to various alternative and exemplary embodiments, the ribs may have a non-rectangular cross-section (i.e. the ribs may be wider at the base than at the edge or may take one of a variety of other configurations). According to various other exemplary and alternative embodiments, the different ribs may extend different distances from the end wall and may terminate at different distances from end 33 of side wall 20.

Reinforcing structures 38 (e.g., ramps, areas of increased thickness, gussets, ribs, etc.) are shown as two members having a gradually increasing thickness that are intended to provide additional support, rigidity, and/or strength to the area of cover 18 between edge 24 of opening 22 and side wall 20. According to one exemplary embodiment, structures 38 extend from the bottom surface of end wall 19 between rib 23 and the radially inner side of recess 30. Each of the two structures 38 starts proximate one end of recess 30 and extends toward the center of recess 30. As each structure 38 extends toward the center of recess 30, its thickness increases. According to one exemplary embodiment, recess 30 includes a substantially flat portion 31 that is configured to receive indentation 29 of skirt 35, and structures 38 transition into flat portion 31. According to various alternative and exemplary embodiments, the reinforcing structures may have a cross-section or thickness that gradually increases along its length from a minimum cross-section at the mid-point to a maximum cross-section at the ends. According to other alternative and exemplary embodiments, the reinforcing structure may have a constant cross-section or thickness along its length.

Stop 40 (e.g., projection, engagement member, element, etc.) is a structure that is intended to cooperate with corresponding structures on the base 14 and insert 16 to coordinate the movement of cover 18, insert 16, and base 14. According to one exemplary embodiment, stop 40 extends from the bottom surface of end wall 19 between the outermost rib 32 and side wall 20 such that when cover 18 is rotated, stop 40 contacts a corresponding element on insert 16, rotating insert 16 relative to base 14 until insert 16 or stop 40 contacts a corresponding element on base 14 that restricts any further rotation of insert 16 or cover 18. According to one exemplary embodiment, one or more gussets 42 (e.g., ribs, brackets, braces, etc.) are provided to rigidify stop 40. According to various alternative and exemplary embodiments, the stop may take any one of a variety of different shapes, sizes, and configurations depending on the shape, size, and configuration of the corresponding structures provided on insert 16 and base 14 and on other potential factors.

Coupling structure 43 (e.g., hook, post, engagement member, barbs, lugs, etc.) is a member that is configured to engage base 14 to couple cover 18 to base 14 in a manner that allows cover 18 to rotate relative to base 14. According to one exemplary embodiment, coupling structure 43 is a generally hollow cylindrical structure that extends downward from the center of the bottom surface of end wall 19. Coupling structure 43 is separated into segments 44 by four wedge-shaped gaps or slits. Each segment 44 includes a radially outwardly extending barb 45 that is configured to engage a corresponding aperture in base 14. According to other exemplary embodiments, coupling structure may be a single segment or may be separated into fewer or more than four segments or may be any other structure that allows cover 18 to be rotatably coupled to base 14.

Figure 8:
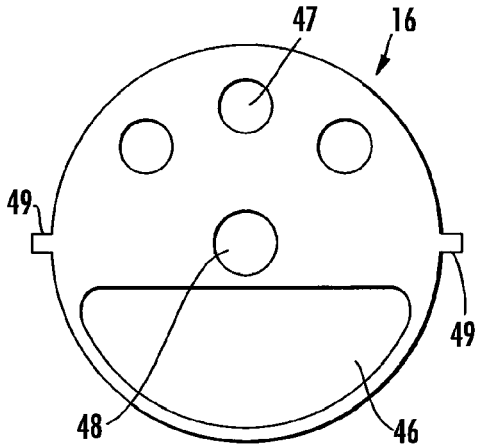
FIG. 8 is a plan view of an insert of the closure of FIG. 1.
Figure 9A:
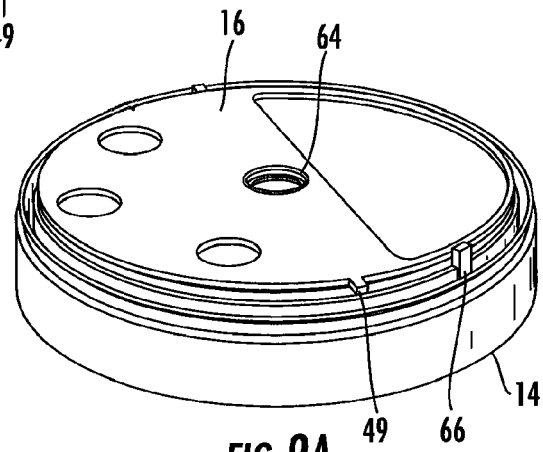
FIGS. 9A and 9B are top perspective views of the insert and a base of the closure of FIG. 1.
Figure 9B:
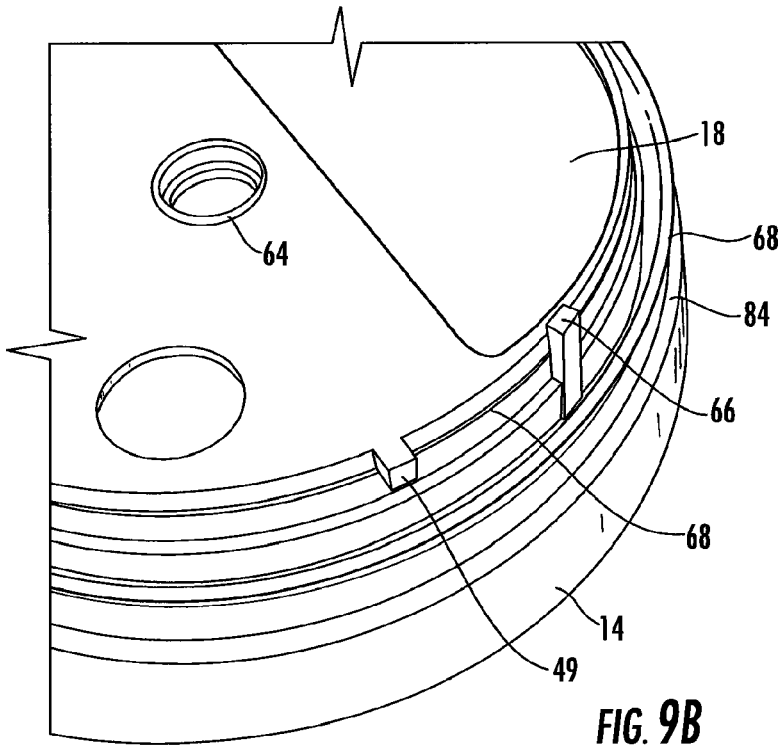

Referring now to FIG. 8, an insert 16 for a closure is shown according to an exemplary embodiment. Insert 16 is a generally thin, flat, round structure that is configured to be coupled between cover 18 and base 14 when closure 10 is assembled and to provide at least one hole pattern for dispensing the contents of the receptacle to which closure 10 is coupled. According to one exemplary embodiment, insert 16 is configured to be rotated between two positions, each position providing a different hole pattern. According to the embodiment illustrated, insert 16 includes a first hole pattern shown as a spoon opening 46 and a second hole pattern shown as shaker openings 47. Spoon opening 46 is a generally semi-circular aperture occupying slightly less than half of insert 16 and corresponds generally in size and shape to opening 22 in cover 18. Shaker openings 47 are shown as three holes arranged on an arc and are located on insert 16 directly opposite of spoon opening 46.

According to various alternative and exemplary embodiments, the hole patterns of the insert may be any suitable shape or size, and may include any number of apertures arranged in one of a variety of different patterns to suit the desired application (e.g., the material to be dispensed from the container.) For example, the insert may include one shaker opening or it may include two or more shaker openings, and each shaker opening may have a shape and size that is suitable to the application in which the closure will be used. Moreover, one or more of the shaker openings may be circular, rectangular, tear-drop shaped, football-shaped, semi-circular, or one of a variety of other shapes. Referring now to FIGS. 12A through 12F, several alternative hole patterns and hole pattern combinations are shown to demonstrate the variety of shapes and patterns possible, though it is not meant to limit insert 16 to these patterns, as many more are possible.

The design of insert 16 allows closure 10 to be easily adapted to different situations and materials by altering only insert 16. For example, a consumer or a manufacturer may be able to adapt a particular cap for a variety of different applications by inserting different inserts.

Insert 16 includes a central aperture 48 that is configured to receive coupling structure 43 of cover 18 as well as a portion of base 14. Aperture 48 is generally larger in diameter than coupling structure 43 and allows coupling structure 43 to be inserted through insert 16 while allowing insert 16 to rotate freely about the central axis 11. To avoid any significant movement or misalignment of insert 16, aperture 48 is configured to receive a portion of base 14 (discussed below) that projects into aperture 48 and that prevents any significant movement of insert 16 in the radial direction. Any movement of insert 16 in the longitudinal direction is limited by the end wall of the base and ribs 23 and 32 of cover 18. Insert 16 also includes two tabs 49 (e.g., protrusions, extensions, lobes, ears, fingers, etc.) that extend radially outward from opposite sides of insert 16 and that are configured to cooperate with stop 40 of cover 18 and the corresponding structure of base 14 to maintain insert 16 in the appropriate position when cover 18 is rotated. According to the embodiment illustrated, tabs 49 are provided at the outer periphery of insert 16.

Referring now to FIGS. 4, 5, 6, and 9 through 10C, base 14 is shown according to an exemplary embodiment. Base 14 provides the structure for coupling closure 10 to receptacle 12 and a surface upon which insert 16 rotates. Base 14 is generally cylindrical in shape and comprises a side wall 52, an end wall 50, one or more ribs 56, and a sealing structure 60.

According to one exemplary embodiment, side wall 52 is a hollow, generally cylindrical member having an open end 53 that is configured to receive a receptacle 12 (e.g., a threaded mouth of a receptacle) and an opposite end 55 that is coupled to, and covered by, end wall 50. An inner surface of side wall 52 includes a coupling structure shown as threads 58. Threads 58 are configured to engage a corresponding coupling structure on receptacle 12 (e.g., a threaded mouth of the receptacle). According to other exemplary embodiments, the coupling structure may be any suitable structure (e.g. press-on rings or snap-fit structure, ribs, etc.) for coupling the closure to the receptacle.

According to one exemplary embodiment, end wall 50 is a generally flat and circular panel that is coupled to end 55 of sidewall 52. End wall 19 includes an opening 54, an aperture 62, a ring 64, a ledge 68, a channel 69, a tab 66, a rim 70, a recess 72.

According to one exemplary embodiment, opening 54 is a generally semi-circular-shaped aperture occupying a little less than half of end wall 50. Opening 54 corresponds generally in size and shape to opening 22 in cover 18 and to spoon opening 46 in insert 16. Aperture 62 is a circular aperture provided in the center of end wall 50 that is configured to receive coupling structure 43 of cover 18 when cover 18 is coupled to base 14. An annular projection or lip shown as ring 64 extends upwardly from the top surface of end wall 50 and substantially surrounds aperture 62. Ring 64 is intended to fit within aperture 48 of insert 16 and has an outer diameter slightly smaller than the diameter of central aperture 48. Ring 64 is generally intended to limit the movement of insert 16 in the plane of end wall 50. The distance ring 64 extends from the top surface or face of end wall 50 is generally equal to the thickness of insert 16 so that the distal end of ring 64 forms a substantially continuous surface with the top face of insert 16.

According to one exemplary embodiment, the outside edge or periphery of end wall 50 is slightly lowered or recessed, forming ledge 68. Ledge 68 is intended to provide a lowered surface that does not interfere with, or that accommodates, stop 40 of cover 18 as cover 18 is rotated relative to base 14.

Channel 69 is an annular groove or recess that extends downwardly into ledge 68. Channel 69 essentially divides ledge 68 into an inner ledge and an outer ledge and is intended to reduce the material used to form closure 10.

Stop 66 (e.g., tab, extension, etc.) is a rigid member that is configured to engage stop 40 of cover 18 and tabs 40 of insert 16 to limit the extent to which each of cover 18 and insert 16 may be rotated relative to base 14. According to one exemplary embodiment, stop 66 extends upwardly from ledge 68 and terminates a distance above the top surface of end wall 19 that is approximately equal to the thickness of insert 16. This helps to ensure that tabs 40 of insert 16 and stop 40 of cover 18 will engage stop 66.

Recess 72 (e.g., channel, groove, etc.) is provided along the periphery of end wall 50 and generally forms a substantially vertical surface 82 and a horizontal surface 84. Recess 72 is configured to receive side wall 20 of cover 18.

Flange 70 (e.g., rim, projection, rib, extension, ring, etc.) is an annular projection that extends radially outward from near the top of vertical surface 82 of recess 72. Flange 70 is configured to cooperate with ridge 34 of cover 18 to couple cover 18 to base 14 in a manner the resists the separation of cover 18 and base 14 while at the same time allowing cover 18 and base 14 to rotate relative to one another. During assembly of closure 10, ridge 34 engages and is forced over flange 70 and rests just below flange 70 to resist axial separation of cover 18 and base 14. According to one exemplary embodiment, the flange is one continuous body. According to various alternative and exemplary embodiments, the flange may be one or more separate bodies or elements distributed around the entire circumference, or a portion of the circumference, of end wall 50.

Ribs 56 (e.g., projections, supports, stiffening members, beams, etc.) are rigid structures that extend across the underside of end wall 50 and are intended to increase the rigidity of base 14. According to one exemplary embodiment, two ribs 56 extend downward from the bottom surface of end wall 50 and have a height approximately equal to the height of sealing structure 60. Ribs 56 are arranged generally symmetrically about central axis 11 and are parallel to one another. According to other exemplary embodiments, the base may include more or less than two ribs, the ribs may be arranged differently (e.g., the ribs may be linear, curved, circular, asymmetric, concentric, etc.), and/or the ribs may have a different height (e.g. less than or greater than the height of sealing structure 60).

Figure 6:
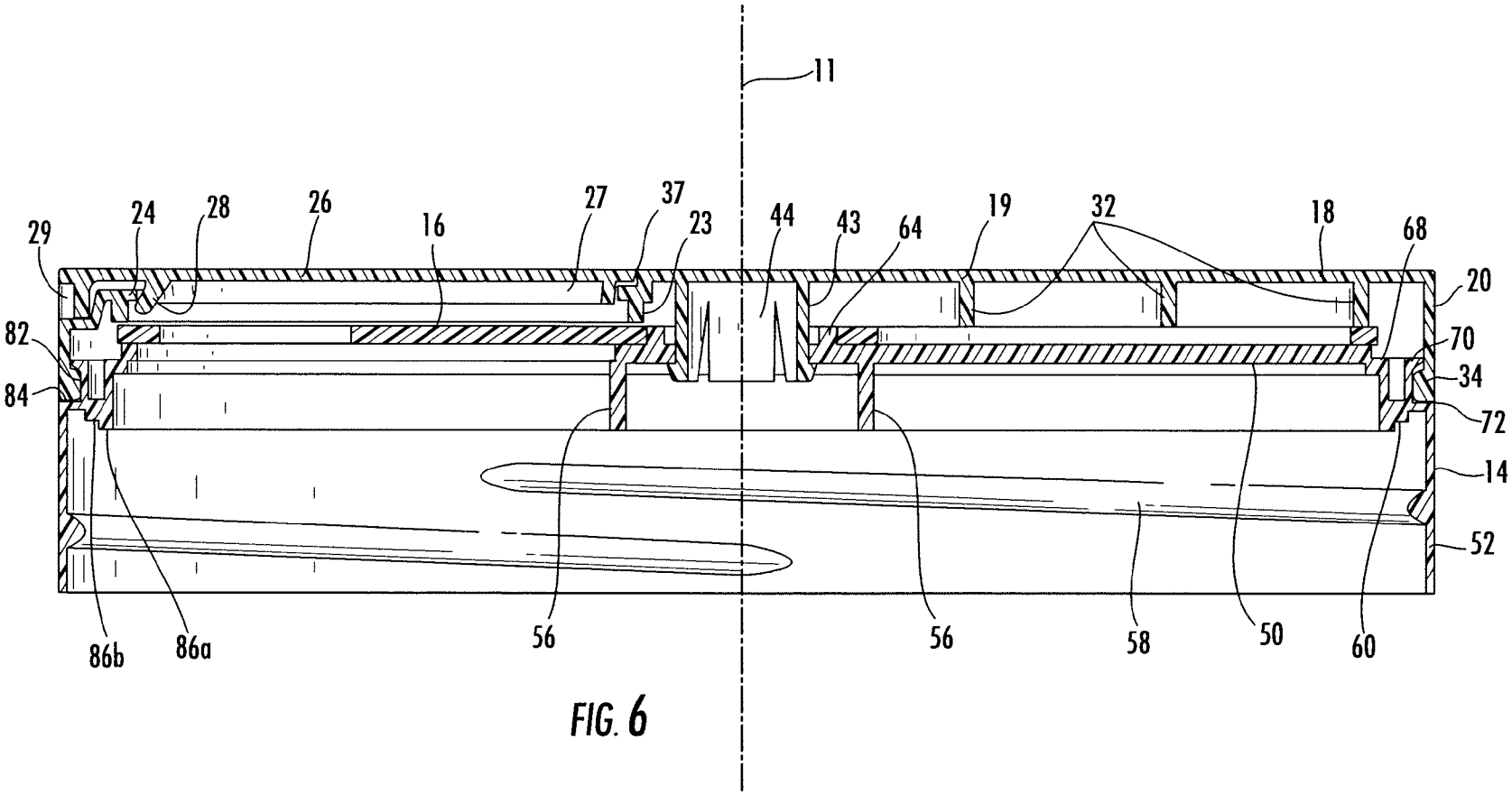
FIG. 6 is a cross-sectional view of the closure of FIG. 3 taken along lines III-III.
Figure 10A:
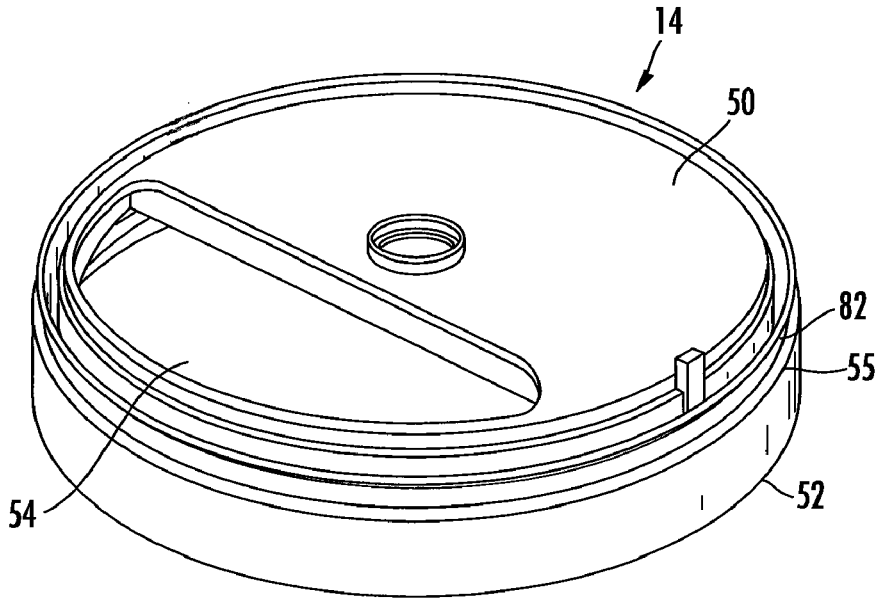
FIG. 10A is a top perspective view of the base of the closure of FIG. 1.
Figure 10B:
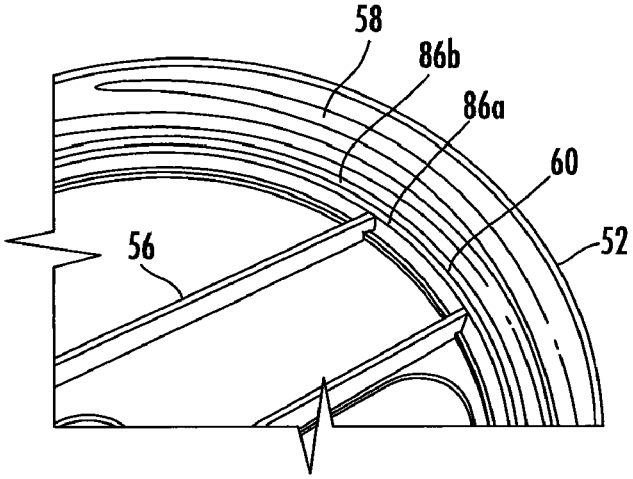
FIG. 10B is a bottom perspective view of a portion of the base of FIG. 10A.
Figure 10C:
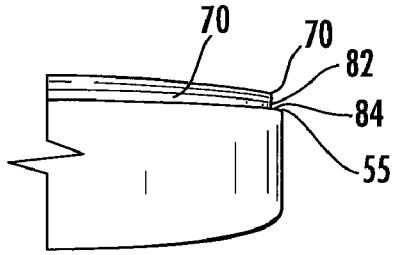
FIG. 10C is a side view of a portion of the base of FIG. 10A.

According to one exemplary embodiment, sealing structure 60 (e.g., ring, sealing ring, stepped sealing ring, etc.) is a projection that includes a plurality of sealing surfaces shown as sealing surfaces 86*a* and 86*b* in FIGS. 6 and 10B. According to one exemplary embodiment, the sealing surfaces may be similar to those shown in U.S. Pat. No. 6,460,718, which is hereby incorporated by reference herein. Sealing structure 60 extends downward from the lower surface of end wall 50 and radially inward from side wall 52. Sealing surfaces 86*a* and 86*b* are arranged in a "step-wise" pattern of coaxial surfaces such that the distance from end wall 50 increases as the diameter of the sealing surface decreases.

According to various alternative and exemplary embodiments, the width of the sealing surfaces in the radial direction may be approximately equal to the thickness of the portion of the receptacle that will contact the sealing surfaces (e.g., the rim or mouth of the receptacle), but the width of the sealing surfaces may be greater or less than the thickness of the receptacle rim. Such step-wise sealing surfaces 86*a* and 86*b* are intended to urge a container mouth that has an out-of-round condition (e.g., oval, etc.) into a generally round condition for sealing against one of the plurality of sealing surfaces 86*a* and 86*b*. Such step-wise sealing surfaces 86*a* and 86*b* may also accommodate variations in the diameters of the mouths of receptacles (e.g., due to variations in tolerances, different container manufacturers or equipment, etc.).

According to various alternative embodiments, the sealing surfaces may be configured so that the distance from the end wall may increase as the diameter of the sealing surfaces increases. According to other alternative embodiments, the sealing surfaces may be flat and parallel to the end wall, or they may have a convex or concave curvature, or they may have any combination of these or other suitable configurations and may be provided at any angle with respect to the end wall. According to other various alternative and exemplary embodiments, the sealing structure may include one, two, four, or any number of sealing surfaces. According to another alternative embodiment, the sealing structure may comprise a single downwardly extending projection (e.g., sealing ring, ridge, rim, etc.) having a shape and location that corresponds with a mouth of a receptacle such that the sealing ring is positioned to abut the mouth when the closure and receptacle are coupled together. According to various alternative and exemplary embodiments, the sealing ring may have a circular outline that is coaxial with the side wall and/or may have a lower edge with a semicircular cross-sectional shape configured to compress a conventional sealing sheet (e.g., liner, etc.) between the sealing ring and the mouth of a receptacle to create a seal. According to other alternative embodiments, the sealing ring may have any suitable cross-sectional shape (e.g., flat, pointed, tapered, etc.) and a width sufficient to provide an effective seal against the mouth of the receptacle. According to various alternative and exemplary embodiments, the sealing ring (such as a stepped sealing ring or a semi-circular sealing ring similar to those previously described) may comprise one or more vent portions (e.g., gaps, notches, openings, etc.) spaced at one or more locations around the sealing ring.

When closure 10 is assembled, cover 18 is coupled to base 14 (e.g., coupling structure 43 of cover 18 engages aperture 62 of base 14 and flange 70 of base 14 engages ridge 34 of cover 18). Insert 16 is located between cover 18 and base 14 (e.g., insert 16 is "sandwiched" between ribs 23 and 32 of cover 18 and base 14) such that it rests on end wall 50 and is rotatable about central axis 11. In the assembled position, tabs 49 of insert 16 extend over ledge 68 and engage tab 66 of base 14. Stop 40 of cover 18 is located such that it extends into the recess forming ledge 68 and engages tab 66 of base 14 and tabs 49 of insert 16. The engagement of tabs 49, tab 66, and stop 40 serve to coordinate the relative movement of cover 18, insert 16, and base 14.

Because the two tabs 49 of insert 16 are 180 degrees apart, insert 16 is permitted to rotate approximately 180 degrees relative to base 14 (the amount of rotation is actually less than 180 degrees due to the thickness of tabs 49 and tab 66). Similarly, cover 18 is permitted to rotate approximately 180 degrees relative to insert 16 (e.g. stop 40 can travel approximately 180 degrees before it contacts a tab 49). To enable a situation where opening 24 of cover 18 corresponds with opening 54 of base 14, cover 18 is coupled to insert 16 and base 14 such that stop 40 can rotate approximately 180 degrees relative to insert 16 before contacting a tab 49 of insert 16 (the contact tab), and then cover 18 and insert 16 can rotate together another approximately 180 degrees relative to base 14 until tab 49 contacts tab 66 of base 14. In this configuration, cover 18 is permitted to move approximately 360 degrees in either direction (e.g., clockwise or counterclockwise) relative to base 14. Of the 360 degrees cover 18 is permitted to rotate, approximately 180 degrees of rotation is relative to both insert 16 and base 14, and the remaining approximately 180 degrees of rotation occurs with insert 16 and is relative to base 14 only. Thus, rotating cover 18 approximately 360 degrees rotates insert 16 180 degrees. Tabs 49 of insert 16 are located such that rotating cover 18 to one extreme places a first hole pattern of insert 16 (e.g., spoon opening 46) between opening 54 of base 14 and opening 22 of cover 18, and rotating cover 18 to the other extreme places a second hole pattern of insert 16 (e.g., shaker openings 47) between opening 54 of base 14 and opening 22 of cover 18.

Figure 11A:
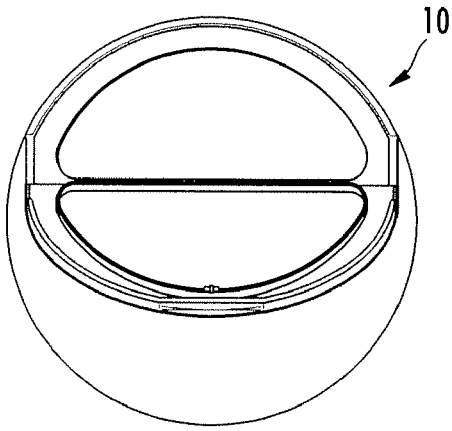
FIGS. 11A through 11E are top views of the closure in FIG. 1 showing the transition from one dispensing aperture set to another dispensing aperture set.
Figure 11B:
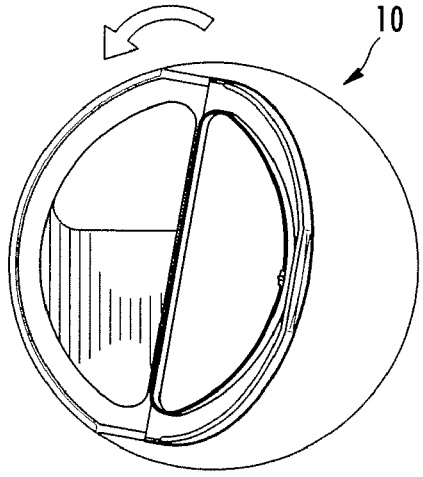
Figure 11C:
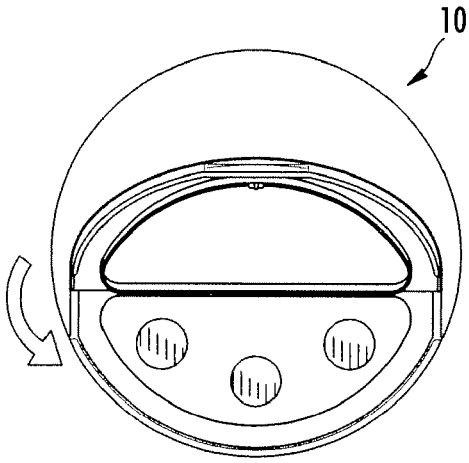
Figure 11D:
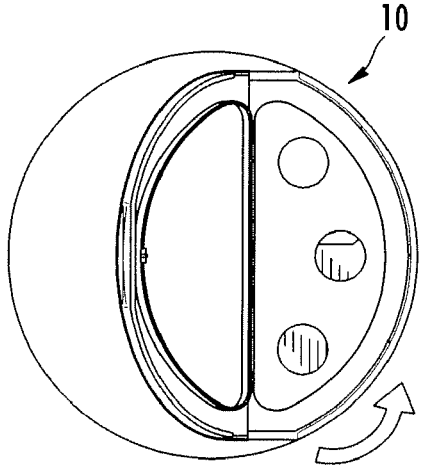
Figure 11E:
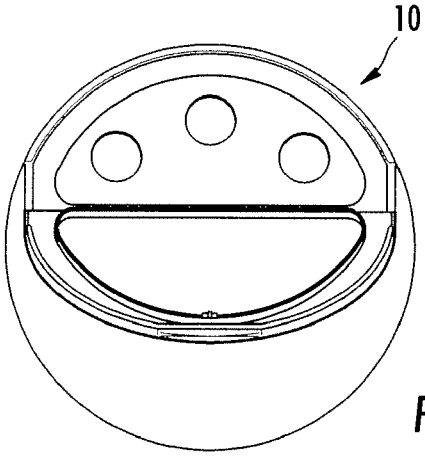
Figure 12A:
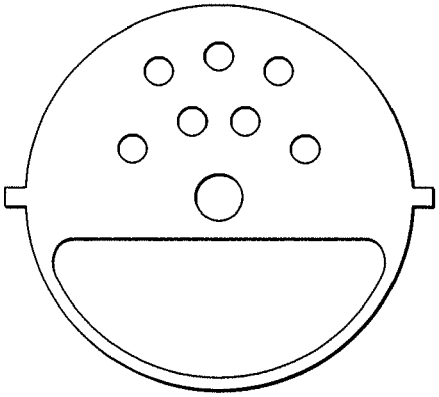
FIGS. 12A through 12F are plan views of inserts according to various exemplary embodiments.
Figure 12B:
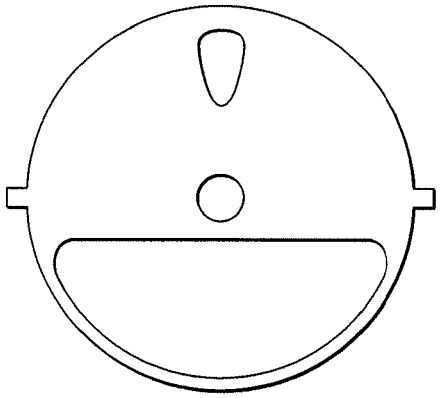
Figure 12C:
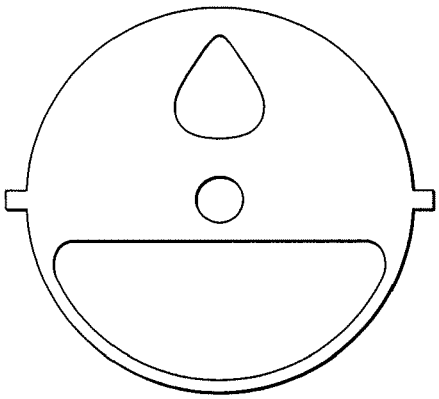
Figure 12D:
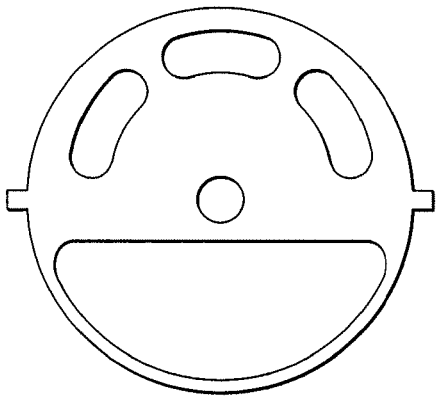
Figure 12E:
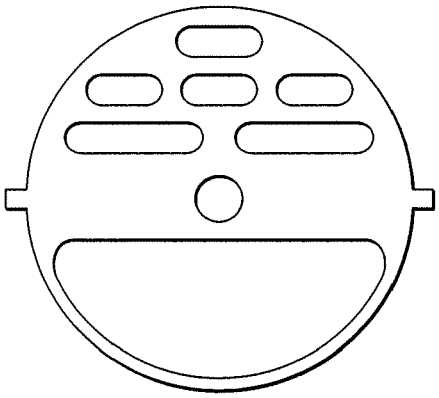
Figure 12F:
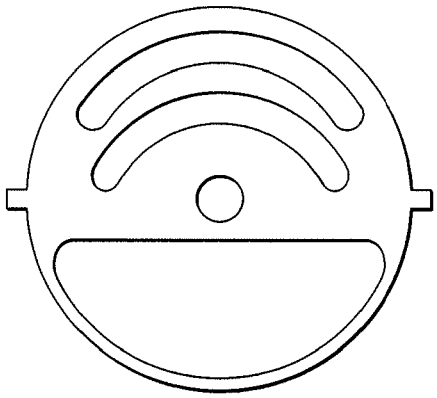

Referring now to FIGS. 11A through 11E, the movement of closure 10 from one dispensing mode to another is shown according to an exemplary embodiment in approximately 90 degree increments. Flap 26 is shown in the open position for clarity. Referring to FIG. 11A, closure 10 is shown in the spoon configuration, with spoon opening 46 of insert 16 aligned with opening 54 of base 14. In FIG. 11B, cover 18 is shown rotated approximately 90 degrees relative to base (e.g., rotated anti-clockwise). Cover 18 is also shown rotated relative to insert 16; however, insert 16 may rotate to a certain extent with cover 18 due, at least in part, to friction. After cover 18 has been rotated some amount (e.g., between approximately 180 degrees and approximately 360 degrees), stop 40 of cover 18 contacts a tab 49 of insert 16 and urges insert 16 to rotate with cover 18. See FIG. 11C. After stop 40 has contacted tab 49, insert 16 is rotated with cover 18 until tab 49 contacts tab 66 on base 14. See FIGS. 11D and 11E. The contact of tab 49 of insert 16 with tab 66 of base 14 and the contact of stop 40 of cover 18 with tab 49 of insert 16 halts the rotation of cover 18 and insert 16 relative to base 14 and serves to align shaker openings 47 of insert 16, opening 22 of cover 18, and opening 54 of base 14. From the shaker position, closure 10 can be converted back to the spoon configuration by rotating cover 18 approximately 360 degrees in the opposite direction (e.g., rotated clockwise).

According to various exemplary and alternative embodiments, a closure for a container is provided that comprises at least one opening for dispensing material from a receptacle and at least one flap for covering the opening or openings. According to various exemplary and alternative embodiments, the closure may be sized to couple to and cover receptacles of different sizes (e.g., a 33 millimeter receptacle, a 38 millimeter receptacle, a 43 millimeter receptacle, a 48 millimeter receptacle, a 53 millimeter receptacle, a 63 millimeter receptacle, a 70 millimeter receptacle, an 89 millimeter receptacle, a 110 millimeter receptacle, a receptacle ranging from anywhere between approximately 20 millimeters and 140 millimeters, etc.).

It is important to note that the construction and arrangement of the elements of the closure for a container provided in this specification are illustrative only. Although only a few exemplary and alternative embodiments of the closure have been described in detail in this disclosure, those skilled in the art who review this disclosure will readily appreciate that many modifications are possible in these embodiments (such as variations in features such as orientation of the flap, skirts and corresponding recesses; variations in sizes, structures, shapes, dimensions and proportions of the flaps, recesses, projections, skirts, stiffeners and other elements; variations in the flap hinge arrangements, number of flaps, configuration and operation of flap closure structures and systems, arrangement and proportioning of spoon and shaker openings, use of materials, colors, combinations of shapes, etc.) without materially departing from the novel teachings and advantages of the invention. For example, the closure may be adapted and sized for use on any type of container or receptacle, or for use on containers or receptacles of different sizes, and/or the closure may be used for dispensing one or more of a variety of different materials or contents. The closure may include any number of different sets of dispensing apertures and each set of dispensing apertures may include one or more of a variety of differently or similarly shaped openings (e.g., a tear-drop, triangular, rectangular, circular, oval, or other shaped opening) arranged in one of a variety of different patterns and be configured to pour one or more of a variety of different materials. According to other alternative embodiments, the closure may be adapted for coupling to a receptacle by a threaded interface or by a snap-on ring or other press-fit engagement structure. It is readily apparent that each of the different embodiments and elements of the closure may be provided in a wide variety of shapes, sizes, thicknesses, combinations, etc. It is also readily apparent that the interfaces and structures for closing the flap may be designed with any profile and configuration suitable for securing the flaps to the base, insert, or cover. Accordingly, all such modifications are intended to be within the scope of the inventions as defined in any appended claims.

The order or sequence of any process or method steps may be varied or re-sequenced according to alternative embodiments. In any claims, any means-plus-function clause is intended to cover the structures described herein as performing the recited function and not only structural equivalents but also equivalent structures. Other substitutions, modifications, changes and omissions may be made in the design, operating configuration and arrangement of the exemplary and other alternative embodiments without departing from the spirit of the present inventions as expressed in any appended claims.

What is claimed is:

1. A closure for a receptacle of a type having an open top and a closed bottom, the closure comprising:

a base configured to be coupled to the top of the receptacle and including a first stop device;

a cover coupled to the base and rotatable relative thereto, the cover including a second stop device and a flap, the flap being configured for selective movement between an open position and a closed position; and an insert supported between the base and the cover, the insert defining at least one dispensing aperture and being rotatable relative to the base, the insert including a first tab and a second tab, the first tab being offset approximately 180 degrees from the second tab, wherein upon the rotation of the cover relative to the base in a first direction, the second stop device engages the first tab and rotates the insert relative to the base until the first tab engages the first stop device, and wherein upon the rotation of the cover relative to the base in an opposite second direction, the second stop device engages the second tab and rotates the insert relative to the base until the second tab engages the first stop device.

2. The closure of claim 1 wherein base comprises:

a cylindrical side wall having a first open end configured to receive the top of the receptacle and a second end; and an end wall supported at the second end of the side wall and having at least one aperture that the at least one dispensing aperture is configured to be selectively aligned therewith.

3. The closure of claim 2 wherein an inner surface of the side wall includes threads configured to engage a corresponding structure on the receptacle.

4. The closure of claim 2 wherein the at least one aperture defined by the end wall is a substantially semi-circular shaped aperture occupying less than half of the end wall.

5. The closure of claim 2 wherein the end wall includes a projection about which the insert rotates.

6. The closure of claim 2 wherein the first stop device comprises a projection extending in a vertical direction past the end wall.

7. The closure of claim 6 wherein the cover comprises:

an end wall having a bottom surfaces; and a side wall having an inner surface, wherein the second stop device comprises a first projection extending from at least one of the bottom surface of the end wall and the inner surface of the side wall.

8. The closure of claim 7 wherein the first tab and the second tab extend radially from an outer periphery of the insert.

9. The closure of claim 1 wherein the cover includes a coupling structure extending downward from a bottom surface of the end wall and engaging a central aperture defined in the base for securing the cover to the base, coupling structure being a projection having a barb located at a free end of the projection for engaging the base.

10. The closure of claim 9 wherein the coupling structure is received by a central aperture defined by the insert.

11. The closure of claim 1 wherein the insert is rotatable between at least two positions with each position providing a different dispensing pattern.

12. The closure of claim 11 wherein the at least one dispensing aperture of the insert includes a plurality of shaker openings and a spooning opening, the plurality of shaker openings being provided on a first portion of the insert, the spooning opening being provided on a second portion of the insert.

13. A container comprising:

a receptacle having an open top and a closed bottom;

a closure coupled to the receptacle, the closure comprising:

a base configured to be coupled to the top of the receptacle and including a first stop device;

a cover coupled to the base and rotatable relative thereto, the cover including a second stop device and a flap, the flap being configured for selective movement between an open position and a closed position; and an insert supported between the base and the cover, the insert defining at least one dispensing aperture and being rotatable relative to the base, the insert including a first tab and a second tab, the first tab being offset approximately 180 degrees from the second tab, wherein upon the rotation of the cover relative to the base in a first direction, the second stop device engages the first tab and rotates the insert relative to the base until the first tab engages the first stop device, and wherein upon the rotation of the cover relative to the base in an opposite second direction, the second stop device engages the second tab and rotates the insert relative to the base until the second tab engages the first stop device.

14. A closure for a receptacle of a type having an open top and a closed bottom, the closure comprising:

a base configured to be coupled to the top of the receptacle, the base comprising:

a side wall;

an end wall supported at the side wall and having an upper surface defining a first dispensing aperture; and a first projection extending upwards in a vertical direction past the upper surface;

an insert supported by the base and defining a second dispensing aperture configured to be selectively aligned with the first dispensing aperture, the insert comprising:

a first tab and a second tab extending radially from an outer periphery of the insert, the first tab being offset approximately 180 degrees from the second tab;

a cover coupled to the base and rotatable relative thereto, the cover comprising:

a flap having an outer edge with a downwardly extending skirt that is configured for selective movement between an open position and a closed position; and a second projection cooperating with the first projection of the base and the first tab and the second tab of the insert to coordinate the rotational movement of the insert relative to the base, wherein upon the rotation of the cover relative to the base in a first direction, the second projection engages the first tab and rotates the insert relative to the base until the first tab engages the first projection, and wherein upon the rotation of the cover relative to the base in an opposite second direction, the second projection engages the second tab and rotates the insert relative to the base until the second tab engages the first projection.

15. The closure of claim 14 wherein the first projection extends upwards past the upper surface a distance that is substantially the same as a thickness of the insert.

16. The closure of claim 14 wherein the first dispensing aperture of the base being provided substantially under the flap of the cover when the first tab is engaged with the first projection and when the second tab is engaged with the first projection.

17. The closure of claim 16 wherein a first dispensing pattern defined by the insert is located under the flap when the first tab is engaged with the first projection, and wherein a second dispensing pattern defined by the insert is located under the flap when the second tab is engaged with the first projection.

18. The closure of claim 1 wherein the cover is rotatable relative to the base slightly less than 360degrees because of a thickness of the first stop device, the first tab, the second tab and the second stop device, and wherein the insert is rotatable relative to the base slightly less than 180 degrees because of the thickness of the first stop device.

19. The closure of claim 12 wherein the plurality of shaker elements are located under the flap when the first tab is engaged with the first stop device, and wherein the spooning opening is located under the flap when the second tab is engaged with the first stop device.

20. The closure of claim 1 wherein the engagement of the first tab with the first stop device restricts further rotational movement of the cover and the insert in the first direction, and wherein the engagement of the second tab with the first stop device restricts further rotational movement of the cover and the insert in the second direction.

* * * * *